United States Patent [19]

Shelton

[11] 4,299,359

[45] Nov. 10, 1981

[54] YARN BOBBIN SUPPORT APPARATUS

[75] Inventor: William E. A. Shelton, Oadby, England

[73] Assignee: Alan Shelton Limited, Croft, England

[21] Appl. No.: 125,908

[22] Filed: Feb. 29, 1980

[30] Foreign Application Priority Data

Mar. 22, 1979 [GB] United Kingdom ..... 10115/79

[51] Int. Cl.[3] ..... B65H 49/02; D03J 5/08

[52] U.S. Cl. ..... 242/131

[58] Field of Search ..... 242/128, 129, 130, 131, 242/131.1; 66/125 R, 161, 163; 28/32

[56] References Cited

U.S. PATENT DOCUMENTS 3,915,406 10/1975 Rolli et al. ..... 242/131

*Primary Examiner*—Leonard D. Christian

*Attorney, Agent, or Firm*—Charles E. Brown

[57] ABSTRACT

The invention provides a yarn bobbin support apparatus for supporting bobbins feeding yarn to a textile machine, comprising a frame assembly a plurality of bobbin support stations arranged on said assembly, means to support at least one bobbin in a selected orientation at each of said stations, said plurality of stations comprising a first group in which the bobbins are supported in a horizontal or near-horizontal orientation and a second group of said stations in which the bobbins are supported in a vertical or near-vertical orientation. Yarn guides may be provided to regulate directional changes of the yarn paths, more guides being provided for the yarns from the first group of stations than for the yarns from the second group.

7 Claims, 2 Drawing Figures

YARN BOBBIN SUPPORT APPARATUS

BACKGROUND OF INVENTION

The invention relates to yarn bobbin support apparatus.

In many textile producing machines, it is necessary to provide yarn supply devices adjacent the operating region of the machine so that the yarn may be drawn off from bobbins and supplied to the machine at the correct tension. The number of bobbins required is frequently very large and it is often found desirable to use large-diameter yarn bobbins or packages, and advantageously to tie the trailing yarn end of a part-spent bobbin to the leading end of the yarn on a replacement bobbin, which is positioned adjacent the first-mentioned bobbin, so that the change-over from the spent bobbin can take place without interruption of the yarn supply.

In certain circumstances it becomes necessary to supply yarn from certain of the bobbins at a different tension than from the remainder. Such an arrangement would, for example, be necessary where the textile machine is a knitting machine equipped with striping attachments which vary the incidence of the appearance of a yarn at the front surface of the fabric being knitted and which are not assisted by additional yarn feed devices, for example, incorporating positive feed.

BRIEF SUMMARY OF INVENTION

The invention has for one of its objects, the provision of apparatus which enables the above requirement to be achieved in an improved manner, at the same time ensuring that despite the number of bobbins in position in the apparatus does not place some of the bobbins out of reach of an operator of average height.

The invention therefore provides yarn bobbin support apparatus comprising a frame provided with a plurality of bobbin support stations, each of said stations including means adapted to support at least one bobbin in a selected orientation, wherein a first group of stations are arranged to support bobbins in a horizontal or near-horizontal orientation and a second group of stations are arranged to support bobbins in a vertical or near-vertical orientation.

Advantageously the stations at which are supported the near-horizontal bobbins may be arranged in vertical columns at a level in the frame below that of the stations at which are supported the near-vertical bobbins. Conveniently, the near-vertical bobbins are arranged in a horizontal plane. It will be understood that the terms "vertical" and "near vertical" used in this specification are intended to include bobbin orientations between 90° and say, 75° to the horizontal, and a similar latitude is to be attributed to the terms "horizontal" and "near-horizontal", as the context permits.

In an example of the invention to be described in detail below, the horizontally disposed bobbins are arranged on a number of vertical columns of the frame in a circle around a knitting machine, the vertically disposed bobbins being arranged in an annular portion of the frame supported on the frame columns.

Yarn is drawn off from all the bobbins and led upwardly to pass through overhead stop motions and tensioners in the conventional manner. Yarn from the horizontal bobbins is drawn firstly in a horizontal path before being led upwardly.

BRIEF DESCRIPTION OF THE DRAWINGS

The example of the invention referred to above will now be described with reference to the accompanying drawings. It will be understood that the description is given by way of example only and not by way of limitation.

In the drawings.

DETAILED DESCRIPTION OF DRAWINGS

Figure 1:
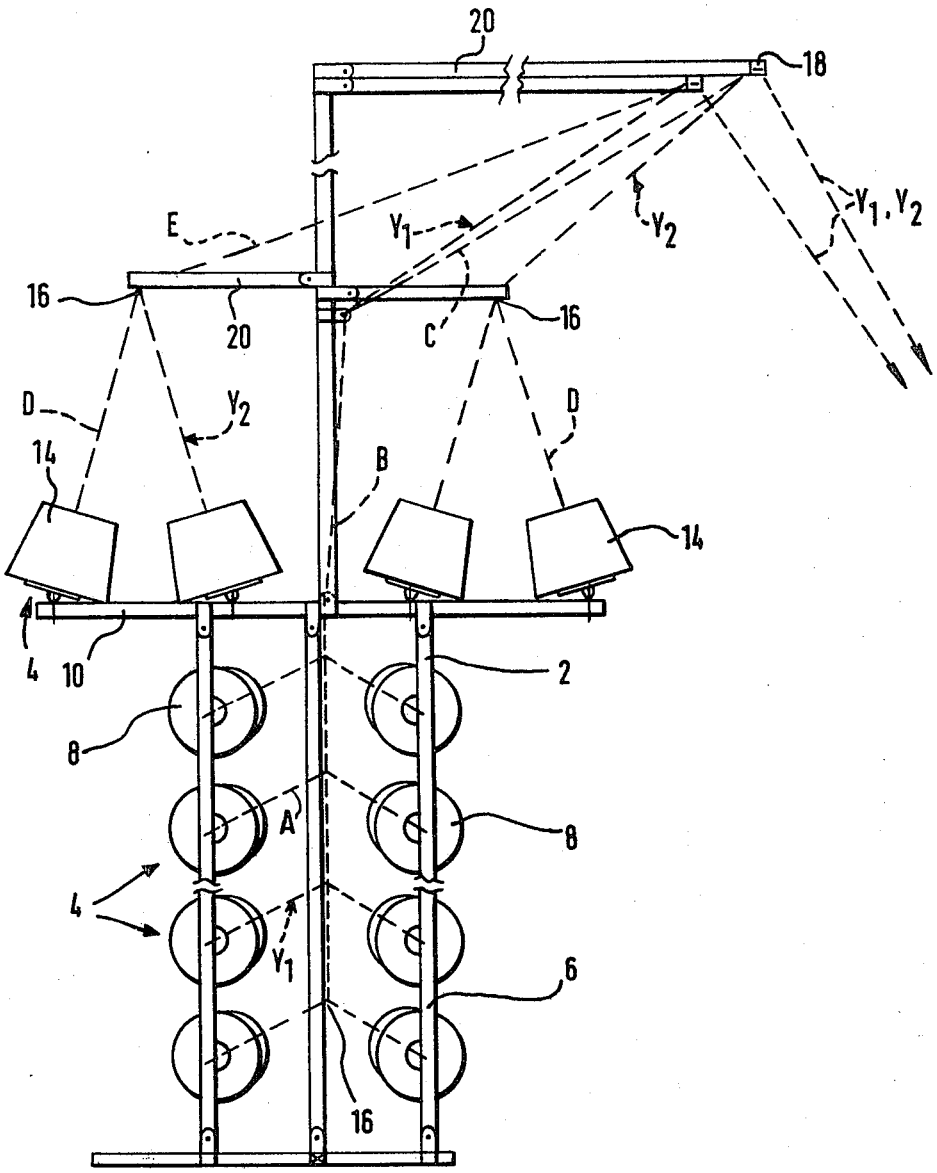
FIG. 1 is a side elevational view of a frame portion of the apparatus, supporting bobbins in both vertical and horizontal orientations.
Figure 2:
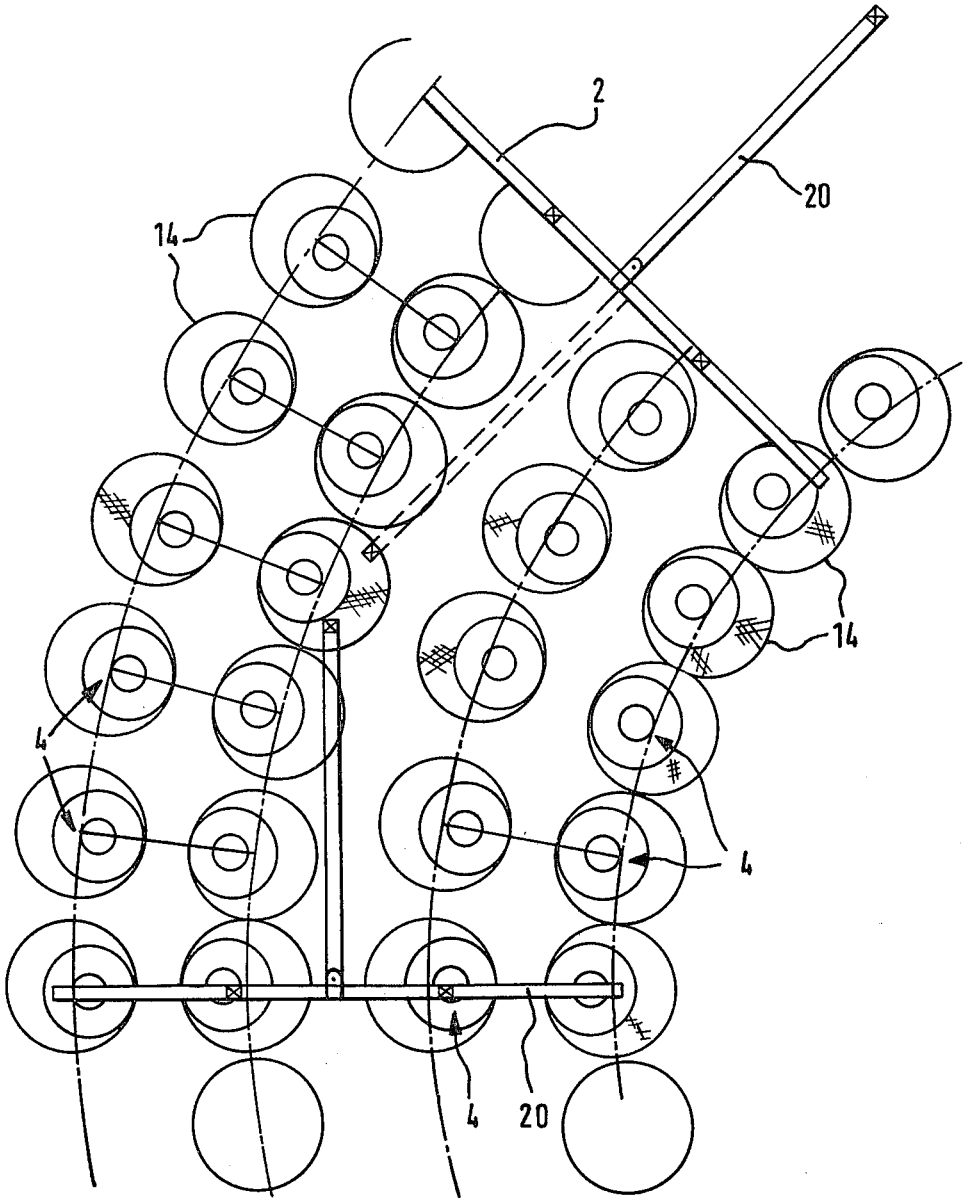
FIG. 2 is a plan view of a portion of the frame portion of FIG. 1, showing only the bobbins in the vertical orientation.

The yarn bobbin support apparatus comprises a frame 2, comprising a plurality of bobbin support stations, indicated at 4, each in the form of pin or rod (not shown) projecting from the frame. The frame 2 comprising a number of separate frame portions, each part-annular in plan, arranged in a circular layout so as to surround a knitting machine (not shown).

The frame portions comprise a plurality of upright members 6 each comprising four stations 4, at each of which a bobbin 8 is supported in a near-horizontal orientation. The frame portions also comprise a number of horizontal curved members 10 supported on the upright members 6 and arranged to follow the circular layout as described above. The curved members upport a plurality of stations 12, at each of which a bobbin 14 is supported in a near-vertical orientation.

All the bobbins 8 and 14 are arranged in pairs in the conventional manner, so that as one bobbin becomes nearly spent the second of the pair is arranged to take over the yarn supply as previously mentioned. Thus each pair is arranged so that the lead-off path of the yarn from one bobbin converges on the yarn path from the second, a yarn guide, conveniently in the form of a ceramic eye 16, being situated at the point of convergence. These yarn guides, together with suitable conventional stop motion devices 18, are mounted on adjustable arms 20 of the structure.

It will be appreciated that one advantage of the arrangement described is that the overall height of the bobbin support structure may be kept within reasonable access of operators who attend to the replacement of spent bobbins, whilst allowing a larger number of bobbin stations within that height restriction.

A second and very important advantage accrues from the difference in the orientation of the bobbins 8 and 14. It will be observed from FIG. 1 that the yarn path $Y_1$ from a bobbin 8 comprises a near-horizontal section A as the yarn leaves the bobbin, followed by a vertical section B between yarn guides 16 and an inclined section C towards the stop motion devices 18, and thence to the machine.

By contrast, the yarn path $Y_2$ from the bobbins 14 comprises a near-vertical section D followed by a section E similar to the section C of the path $Y_1$. The yarn path $Y_1$ will thus be seen to involve a greater number of changes of direction of the yarn, having an additional turn through approximately 90° between sections A and B. Thus, a higher level of tension is imparted to the yarn coming from the bobbins 8 than from the bobbins 14. This difference in tension is readily utilised in providing the necessary tension levels when striping attachments are in use in the knitting machine.

I claim:

1. Yarn bobbin support apparatus for supporting bobbins feeding yarn to a textile machine, comprising a frame assembly a plurality of bobbin support stations arranged on said assembly, means to support at least one bobbin in a selected orientation at each of said stations, said plurality of stations comprising a first group of said stations in which bobbins are supported in a horizontal or near-horizontal orientations and a second group of stations in which bobbins are supported in a vertical or near vertical orientation, yarn guides disposed in association with each of said groups of said stations to regulate directional changes in a path for yarn leaving a bobbin at each of said stations, the number of said yarn guides provided in the path from each station in the first group of said stations being at least one more than the number of yarn guides provided in the path from each station in the second group of said stations, thereby ensuring that the yarns from the first group of said stations take paths of greater circuitousness than yarns from the second group of said stations.

2. Yarn bobbin support apparatus for supporting bobbins feeding yarn to a textile machine, comprising a frame assembly a plurality of bobbin support stations arranged on said assembly, means to support at least one bobbin in a selected orientation at each of said stations, said plurality of stations comprising a first group of said stations in which bobbins are supported in a horizontal or near-horizontal orientations and a second group of said stations in which bobbins are supported in a vertical or near-vertical orientation, the first group of said stations being arranged at a level above that of the second group of said stations in the frame assembly, yarn being drawn off from one and/or both groups of said stations according to the requirements of the textile machine.

3. Yarn bobbin support apparatus for supporting bobbins feeding yarn to a textile machine, comprising a frame assembly a plurality of bobbin support stations arranged on said assembly, means to support at least one bobbin in a selected orientation at each of said stations, said plurality of stations comprising a first group of said stations in which bobbins are supported in a horizontal or near-horizontal orientations and a second group of stations in which bobbins are supported in a vertical or near vertical orientation, the frame assembly comprising a plurality of vertical columns arranged in a substantially circular or part-circular layout, said vertical columns bearing said first group of said stations, and further comprising an annular frame portion positioned at a level above that of the arrangement of the vertical columns, said annular frame portion bearing said second group of said stations.

4. Apparatus according to claim 1, wherein the first group of said stations is arranged at a level above that of the second group of said stations in the frame assembly, yarn being drawing from one and/or both groups of said stations according to the requirements of the textile machine.

5. Apparatus according to claim 3, wherein the first group of said stations is arranged at a level above that of the second group of said stations in the frame assembly, yarn being drawing from one and/or both groups of said stations according to the requirements of the textile machine.

6. Apparatus according to claim 1, wherein the frame assembly comprises a plurality of vertical columns arranged in a substantially circular or part-circular layout, said vertical columns bearing said first group of said stations and further comprises an annular frame portion positioned at a level above that of the arrangement of the vertical columns said annular frame portion bearing said second group of said stations.

7. Apparatus according to claim 4, wherein the frame assembly comprises a plurality of vertical columns arranged in a substantially circular or part-circular layout, said vertical columns bearing said first group of said stations and further comprises an annular frame portion positioned at a level above that of the arrangement of the vertical columns said annular frame portion bearing said second group of said stations.

* * * * *